US010729237B2

(12) United States Patent
Arriagada Lama

(10) Patent No.: US 10,729,237 B2
(45) Date of Patent: Aug. 4, 2020

(54) CONFIGURABLE AND DISMANTLABLE DISPLAY CASE SYSTEM COMPRISING A PLASTIC SHELVING UNIT WITH TRAYS AT DIFFERENT LEVELS, AND METHOD OF ASSEMBLY

(71) Applicant: MBM SpA, Santiago (CL)

(72) Inventor: Christian Andres Arriagada Lama, Santiago (CL)

(73) Assignee: MBM SpA, Santiago (CL)

( * ) Notice: Subject to any disclaimer, the term of this patent is extended or adjusted under 35 U.S.C. 154(b) by 155 days.

(21) Appl. No.: 15/737,941

(22) PCT Filed: Jun. 13, 2016

(86) PCT No.: PCT/CL2016/000029
§ 371 (c)(1),
(2) Date: Dec. 19, 2017

(87) PCT Pub. No.: WO2016/205965
PCT Pub. Date: Dec. 29, 2016

(65) Prior Publication Data

US 2018/0168337 A1 Jun. 21, 2018

(30) Foreign Application Priority Data

Jun. 24, 2015 (CL) ..... 1832-2015

(51) Int. Cl.
*A47B 47/04* (2006.01)
*A47F 5/00* (2006.01)
(Continued)

(52) U.S. Cl.
CPC ..... *A47B 47/045* (2013.01); *A47B 47/00* (2013.01); *A47B 47/047* (2013.01); *A47F 5/00* (2013.01); *F21V 33/00* (2013.01); *A47F 5/0062* (2013.01)

(58) Field of Classification Search
CPC ... A47B 47/042; A47B 47/045; A47B 47/047; A47B 47/0091; A47F 5/00; A47F 5/0062
(Continued)

(56) References Cited

U.S. PATENT DOCUMENTS 5,270,366 A * 12/1993 Hein ..... C08K 3/32 524/145
2008/0302748 A1* 12/2008 Tsai ..... A47B 45/00 211/188

(Continued)

FOREIGN PATENT DOCUMENTS

EP 1982622 A1 * 10/2008 ..... A47F 5/01

*Primary Examiner* — Michael Safavi
(74) *Attorney, Agent, or Firm* — Johnson & Martin, P.A.; James David Johnson

(57) ABSTRACT

A configurable, dismantlable display case system, with supports for promotional graphics, for use as a display cabinet, the constitution thereof being simple and entailing a reduced cost, and with the possibility of changing the configuration of its assembly and the promotional campaign thereon. The modular display system consists generally of a plastic shelving unit, with trays at different levels, linked at their corners by means of pillars consisting of PVC profiles, of a generally triangular shape, which fit adjustably into corresponding housings, one at each corner and on both sides of each tray; short profiles formed by extruded PVC profiles of a more reduced length than the pillar profiles, of a generally triangular shape with rounded corners which slot adjustably into the corresponding housings of the tray, and comprising non-slip ferrules inserted into the profile forming the leg at the area in contact with the floor; and assembly method.

20 Claims, 12 Drawing Sheets

(51) Int. Cl.
*F21V 33/00* (2006.01)
*A47B 47/00* (2006.01)

(58) Field of Classification Search
USPC ..... 211/194, 153, 188; 108/156, 158.12, 64, 108/91, 180, 185, 186, 192; 40/606.08; D6/675.1
See application file for complete search history.

(56) References Cited

U.S. PATENT DOCUMENTS

2009/0107938 A1* 4/2009 Miller, Jr. ..... A47F 3/0404 211/133.6
2013/0055604 A1* 3/2013 Herman Baran ..... A47B 45/00 40/606.03
2013/0221818 A1* 8/2013 Ceballos Godefroy ..... A47B 43/00 312/258
2015/0191961 A1* 7/2015 Yang ..... E06B 3/221 428/34.5
2015/0323105 A1* 11/2015 Lee ..... F16L 9/14 138/140

* cited by examiner

CONFIGURABLE AND DISMANTLABLE DISPLAY CASE SYSTEM COMPRISING A PLASTIC SHELVING UNIT WITH TRAYS AT DIFFERENT LEVELS, AND METHOD OF ASSEMBLY

FIELD OF THE INVENTION

The present invention relates to a configurable, dismantlable display case system, with specific supports for promotional graphics, particularly suited for use as a display cabinet, which may be used in all types of shopping malls, fairs and promotional events, the constitution thereof being simple and entailing a reduced cost, and with the possibility of changing the promotional campaign thereon as many times as may be necessary.

BACKGROUND OF THE INVENTION

Promotional campaigns for certain articles are very common at stores; usually of limited duration and basically consisting of locating the articles publicised in a prominent or notable location, by means of shelving distinguishable from the remainder.

These campaigns are of limited duration; the cabinet used for the same therefore has a limited validity or life. It is therefore advisable to employ a simply-configured cabinet entailing a reduced cost which, in spite of the foregoing, provides the characteristics of safety and appearance necessary for the purpose for which it is intended.

The modular shelving unit of the present invention is an array of devices that configure a modular, assemblable shelving unit, this being the solution to the main problems and difficulties entailed by previous assemblable shelving units for the display of products at sales outlets, these being: the disposability of the cabinet, the impossibility to configure the same according to the space available and the inexistence of specialised supports for promotional campaigns.

Currently, the companies that manufacture assemblable shelving units used for the displaying of products in sales outlets only provide the basic structure of the shelving unit, i.e. a tray with housings for the installation of pillars, which can only be installed individually, either higher or lower. The latest developments seen include special housings for the installation of promotional graphics, enabling the continued use of the cabinet, since the replacement of the publicity simplifies the change thereof with no detriment to the shelving unit.

Notwithstanding the aforesaid, the main problem still presented by the most modern shelving units is that it is difficult to configure the same horizontally in order to cover larger surfaces.

Until the present, one solution has been to affix one shelving unit to another by means of cables or cords. Another advantageous solution known is a shelving unit with trays of a trapezoidal outline, which includes cylindrical pillars enabling the coupling of the trays at different levels, joined at their corners by means of clamps; this solution enables the lateral configuration of the shelving units, by joining the trays at a single pillar by means of the clamps; however, not all configurations permit the determination of trays on the same plane, nor is there a possibility of including interchangeable promotional graphics.

With regard to the known prior art, there exists a need for a visually attractive modular display system with appropriate characteristics for its use in all types of shopping malls, fairs and promotional events, which may be configured in a wide variety of shapes and sizes, is simple to assemble and dismantle, with interchangeable publicity and at a reduced cost.

DESCRIPTION OF THE INVENTION

The principal object of the present invention is to provide a modular display system with constructional characteristics that enable the display of a wide variety of products to users.

Another object of the present invention is to define an assemblable, modular display system, in such a way that a wide variety of shapes and sizes of display systems may be defined.

Yet another object of the present invention is to define a system for the displaying of products that enables the incorporation of interchangeable promotional graphics, enabling the same display unit to alternate between different products, with no detriment to the shelving and dispensing totally with adhesives, thus enabling the re-use of the display unit in successive promotional campaigns.

And yet another object of the present invention is to define a system for the displaying of products that is pleasing to the eye.

And yet another object of the present invention is to define a display system that enables the illumination of the products displayed.

In general, the modular display system which is the object of the present invention consists of a plastic shelving unit, with trays at different levels, linked at their corners by means of pillars of a generally triangular profile which fit adjustedly into corresponding housings, one at each corner and on both sides of each tray.

The trays feature a flat upper surface of a generally quadrangular shape and with a predetermined thickness, defining a frontal edge, a rearward edge and lateral edges, on which the products to be displayed are placed. The trays are preferably manufactured from PP (polypropylene).

The tray is comprised of a flat, quadrangular horizontal surface, on which the products to be displayed are placed, and an external wall, perpendicular to the flat surface, and whose medial line is marked by the external line of the square horizontal surface of the tray. The internal side of the wall, above the tray, is that which retains the products displayed, while the internal half of the wall, below the tray, features internal ribs which endow the tray of the device with structure, rigidity and strength. The housing at each corner is of a generally triangular shape with rounded corners, being visible and functional from both above and below the tray. The purpose of this housing is that each shall bear the pillars, which are of the same calibre as the housing, inserted from above or from below the tray, for the assembly of the shelving unit.

Furthermore, at the centre of the trays four housings are defined, for pillars closely facing each other; these four housings are also intended to receive and hold the profiles, but only from above the tray, thus enabling the configuration of new levels for the shelving unit, or the installation of promotional graphics.

Each tray further features at its corners male-female connecting means, whose purpose is to laterally connect corresponding shelving units one to another. The male-female connecting means are located vertically at the lateral edges of each tray, at one extremity a female connector and at the other extremity a male connector, at the four lateral edges.

The connectors enable the horizontal interconnection between trays, enabling the modular shelving units to adapt to the space available in each sales outlet, since the interconnection facilitates the horizontal growth of the shelving units on the display premises. These connectors are a male connector and a female connector, alternating on the external side of each corner of the tray.

The pillars are formed by two types of extruded PVC profiles, designed to slot into all the triangular housings of the tray (at the corners or centrally). Assembly of the pillars and the housings of the tray is performed by press-fitting, inserting the profile into the housing in question and pressing said profile until it butts against the stop at the base of the housing. The shape of the profile is generally triangular with rounded extremities, causing the profiles to slot exactly into the housings of the tray, ensuring the firmness and rigidity of the shelving unit thus formed. All the profiles feature perforations, which are used for the riveting of graphics or anti-theft protective plates. The perforations may also be used for the passage of the lighting cables. Notwithstanding that the profiles are standardised, they may be sized to measure, in the event that the product to be displayed be particularly high and should require a greater space between one tray and another. However, there are two standard lengths of profile: shorter, measuring 150 mm and with four perforations; this profile serves a double purpose, since its reduced length is suited, on the one hand, for the legs of the shelving unit, subsequent to the affixing of a rubber stop or non-slip ferrule manufactured from TPE (thermo-plastic elastomer) to its lower surface to endow the shelving unit with adherence and sustainability. The other function of these profiles is to act as a rail and support for anti-theft protective plates. To this end, the profile features two lateral perforations, located at the flat sides of the profile. On installing this profile in the upper tray of the shelving unit, its lateral perforations enable the affixing thereto of the protective plate. The other standard dimension of the profiles is 350 mm, with six perforations. This profile (and likewise any other profile of greater length) serves to determine the internal height of the shelving unit or the separation between the trays forming the shelving unit, as required by the products to be displayed.

The pillars with a generally triangular profile with rounded corners are extruded, hollow and manufactured from PVC (polyvinyl chloride) stabilised with tin or lead, with pairs of perforations longitudinally spaced on their sides.

At each of the lateral edges of the tray, engaging grooves are also defined, directed longitudinally with regard to a vertical plane, and laterally, departing at an acute angle with regard to this outwardly facing plane of the tray. The distances between grooves are less than the width of the tray and less than a distance between the male-female connectors.

A flat, smooth board may be inserted into the engaging grooves of each tray, being the height of the shelving unit and covering at least one external side of two consecutive trays, assembled with their corresponding pillars. This board serves as a supporting format for the lateral promotional graphics, covering the entire height of the shelving unit and is fixed by tension within the engaging grooves.

At the front edge and the rearward edge of the trays a channel is defined, formed between vertical grooves similar to the grooves at the lateral sides, and a horizontal groove linked to the vertical groove; these grooves act as a supporting channel for a flat, smooth board as for promotional graphics of the price ticket strip type.

In both formats, thanks to the design incorporated in the support for promotional graphics, the design and location of these supports incorporated in the tray solves the problem of affixing the promotional graphics by means of adhesives, this now being unnecessary, thus facilitating the indefinite re-use of the product display device at sales outlets and enabling a total change of promotional graphics, it only being necessary to change the boards and price ticket strips.

The incorporation of the aforementioned lateral connectors enables the horizontal configuration of the shelving units, with the advantage that on termination of their use they may be dismantled or even remodelled into a different configuration.

Another device featured by the tray is the channel or housing for LED (light emitting diode) lighting. Two lateral channels have been incorporated on the surface of the tray, located at opposing internal edges of the tray, just inside the location of the price ticket strip-like supports. These channels are of the same width as an LED strip and are angled at 45° to facilitate the illumination of the products placed in the shelving unit. Thanks to this solution, it is now possible to install a LED strip in each channel, enabling the illumination of the products displayed.

The LED strip is installed throughout the length of the cavity and its cables may be routed through the interior of the shelving unit to the floor, through perforations especially located in both the trays and the extruded profiles.

The design of the tray also features specific perforations for the cabling of the module with the LED strips. The perforations are located at each extremity of the illumination channels and enable the cable to be routed toward the lower part of the shelving unit for its connection to the power source. In addition, all the housings for the insertion of pillars feature a perforation at their base, executed for the passage thereby of the cables and their downward routing.

The shelving unit is assembled commencing with the tray featuring its housings and a set of pillars or structural profiles which are inserted into the housings of the tray to assemble the shelving unit desired. Similarly, by means of the connectors at the lateral edges of each tray, the trays may be assembled horizontally, to form larger shelving units, covering a greater space within the sales outlet in which it is used.

The anti-theft plate is defined as an accessory; this consists of a rectangularly-shaped sheet of polycarbonate, cut to the width of the vertical pillars of the cabinet and perforated in order to fit together with the standard perforations of the extruded profiles.

Another accessory is the diagonalization adaptor, consisting of a solid item of plastic, designed to be inserted so as to join two horizontal female connectors of the tray, thus enabling the joining of several shelving units to form a diagonally staggered line.

Yet another accessory is a foot to be installed at the underside of a tray, featuring a generally triangular profile and with an internal threaded hole for the installation of castors, thus to configure a mobile shelving unit.

Finally, the tray further incorporates symbols for the identification of faces or sides. To facilitate assembly and the identification of the faces of the tray, said tray distinguishes with a plus sign (+) the sides featuring the support for the price ticket strip graphics, and with a minus sign (−) the sides on which the supports for lateral graphics are located.

DESCRIPTION OF THE DRAWINGS

As a supplement to the description made herein, and for the purpose of aiding the better understanding of the characteristics of the invention, in accordance with preferred examples of a practical embodiment of the same, a set of drawings is attached as an integral part of said description wherein, by way of illustration and not limitation, the following is portrayed.

Figure 1:
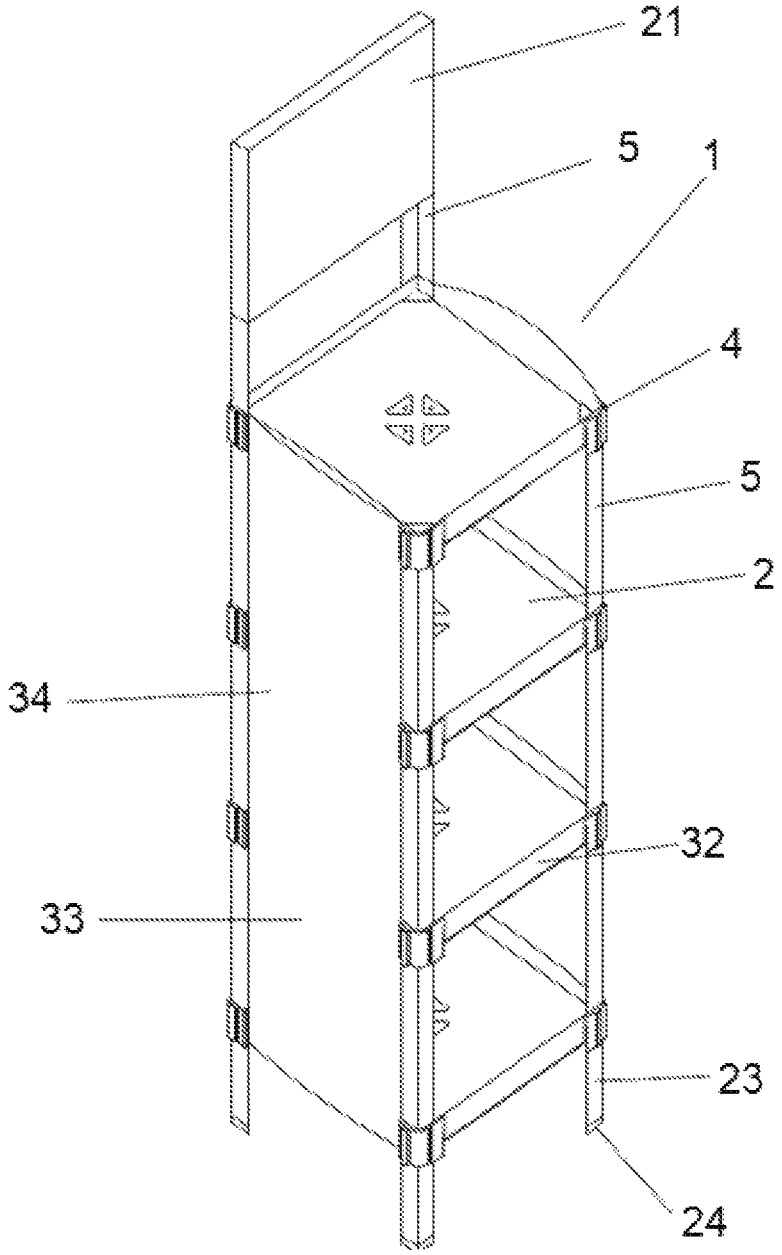
FIG. 1.—Portrays an isometric view of the shelving unit which is the object of the invention, in an assembled state and with the configuration of a simple shelving unit.
Figure 2:
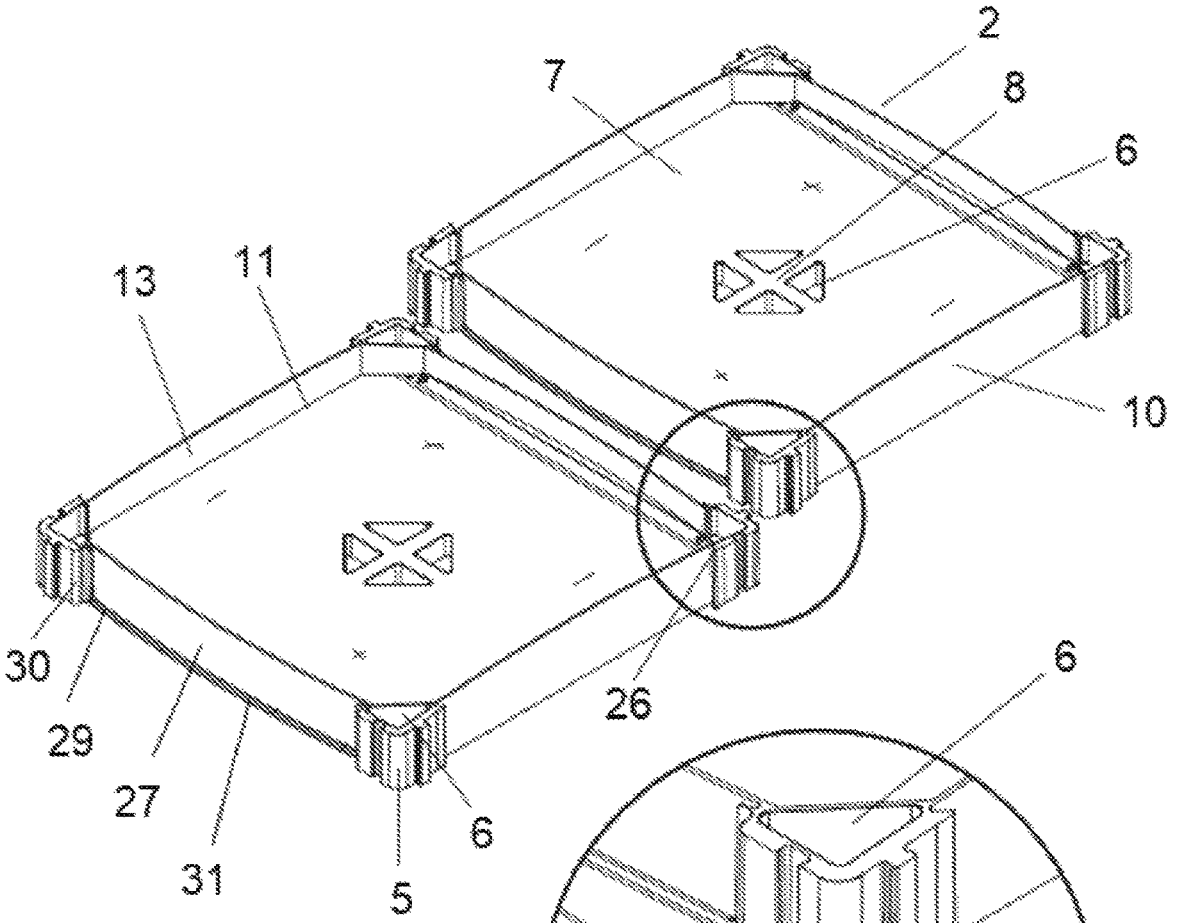
FIG. 2.—Portrays an isometric view of a tray and the means for its connection by slotting together with another tray of like characteristics.
Figure 3:
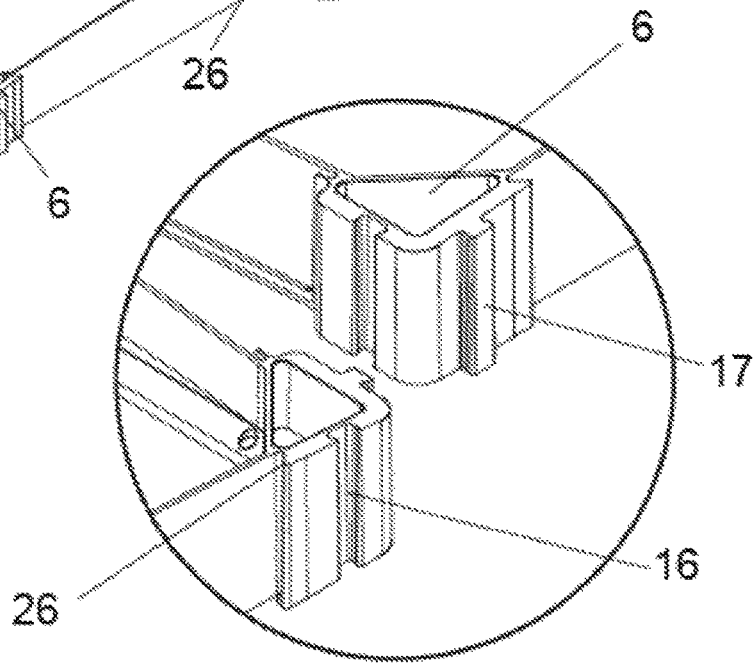
FIG. 3.—Portrays an enlarged view of the slotting together portrayed in FIG. 2.
Figure 4A:
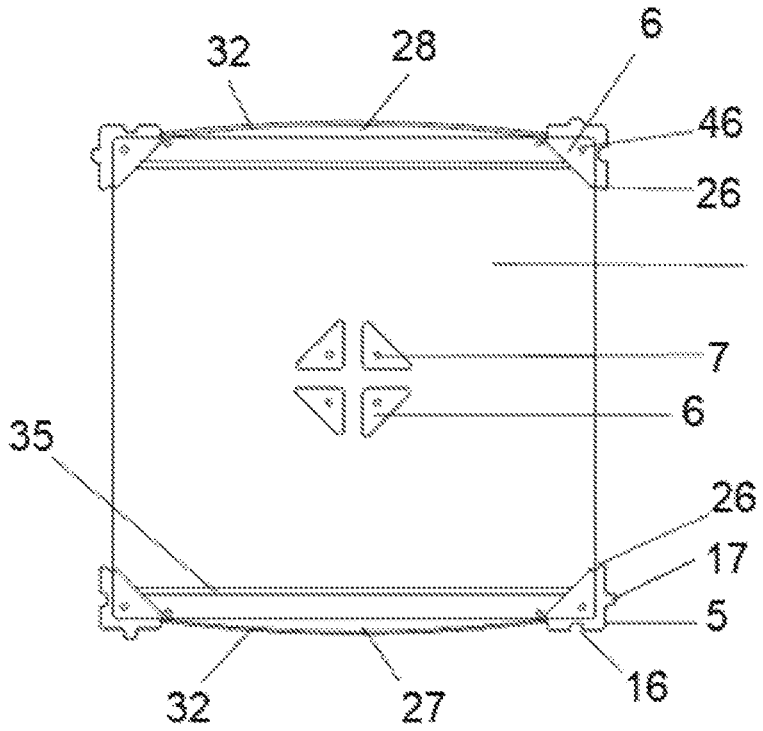
FIG. 4*a*.—Portrays a view from above of the tray which is the object of the invention.
Figure 4B:
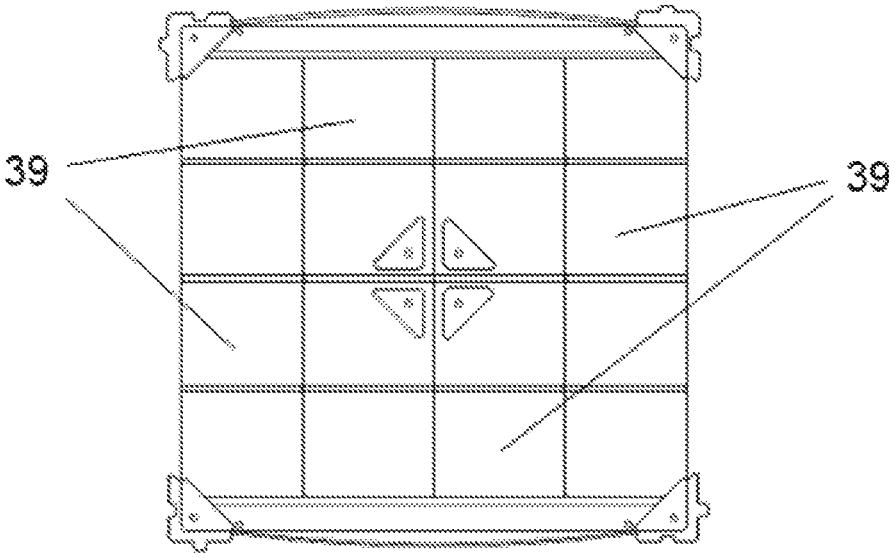
FIG. 4*b*. Portrays a view from above of the tray which is the object of the invention, displaying its identifying symbols.
Figure 5:
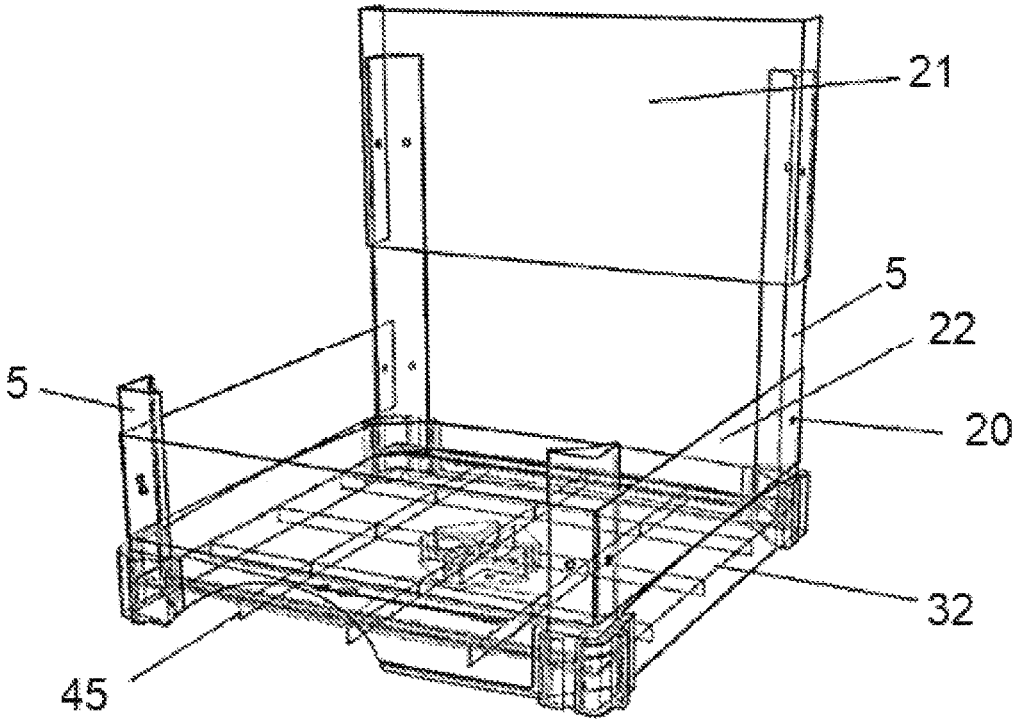
FIG. 5.—Portrays a detail of an isometric view of the pillars with protective plates.
Figure 6:
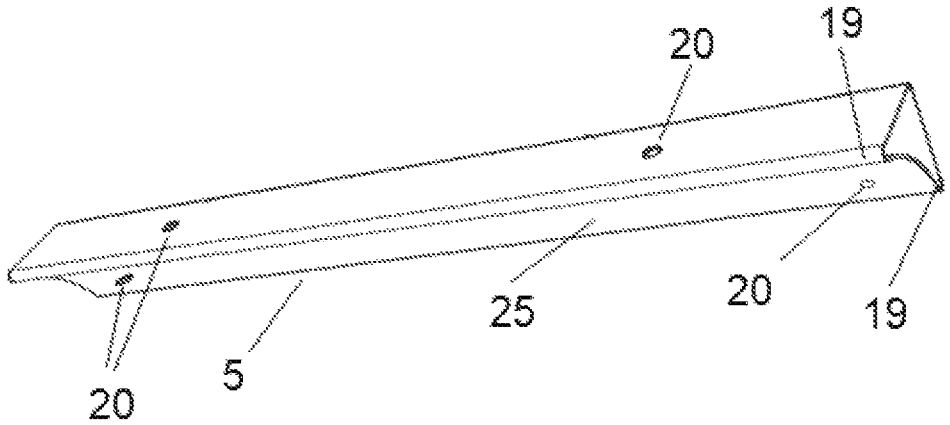
FIG. 6.—Portrays an isometric view of a pillar or triangular profile.
Figure 7A:
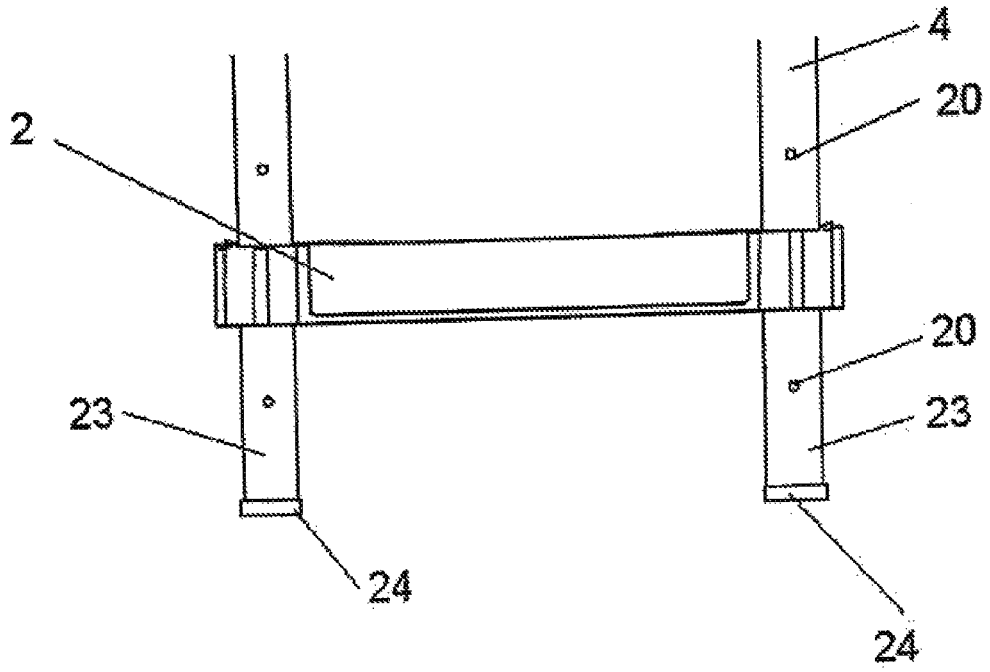
FIG. 7*a*.—Portrays a front view of the legs of the shelving unit including non-slip elements or ferrules.
Figure 7B:
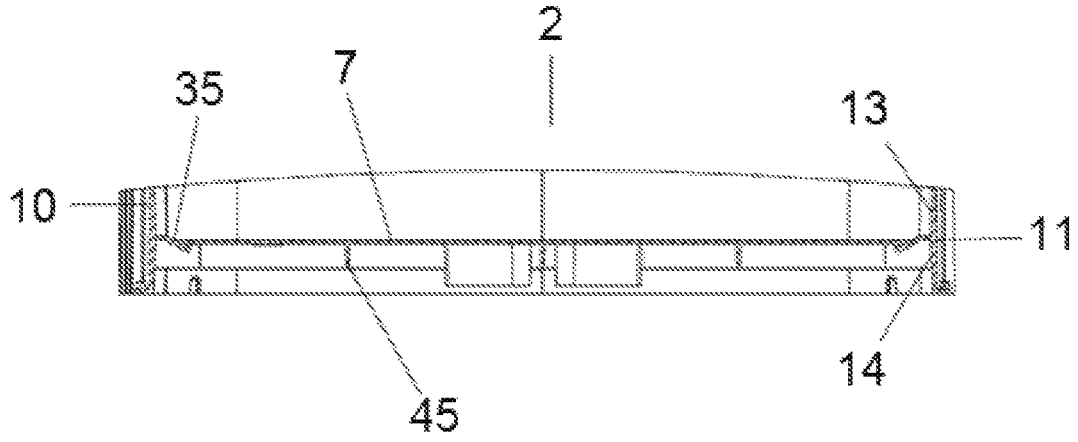
FIG. 7*b*.—Portrays a cross-sectional view of the central part of a tray.
Figure 8A:
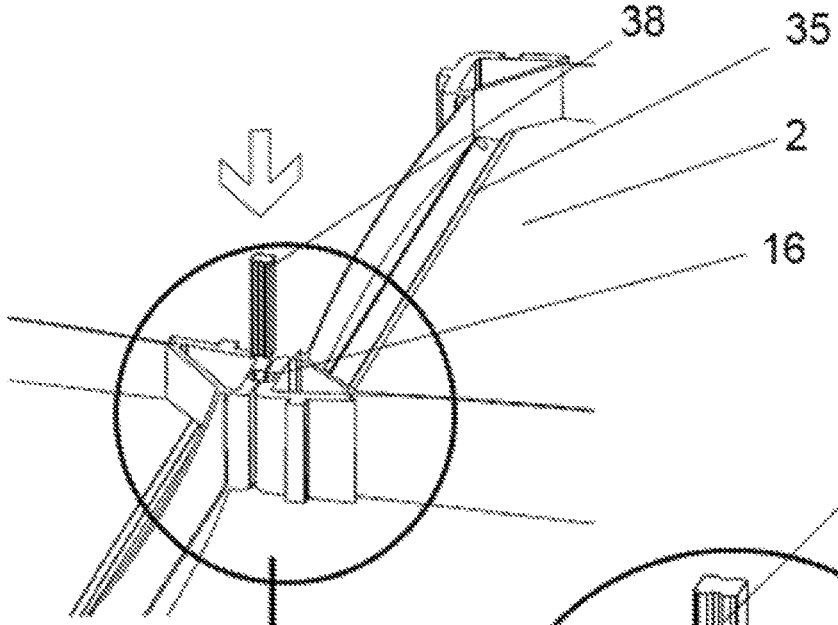
FIG. 8A.—Portrays an isometric view of a diagonalized coupling between trays.
Figure 8B:
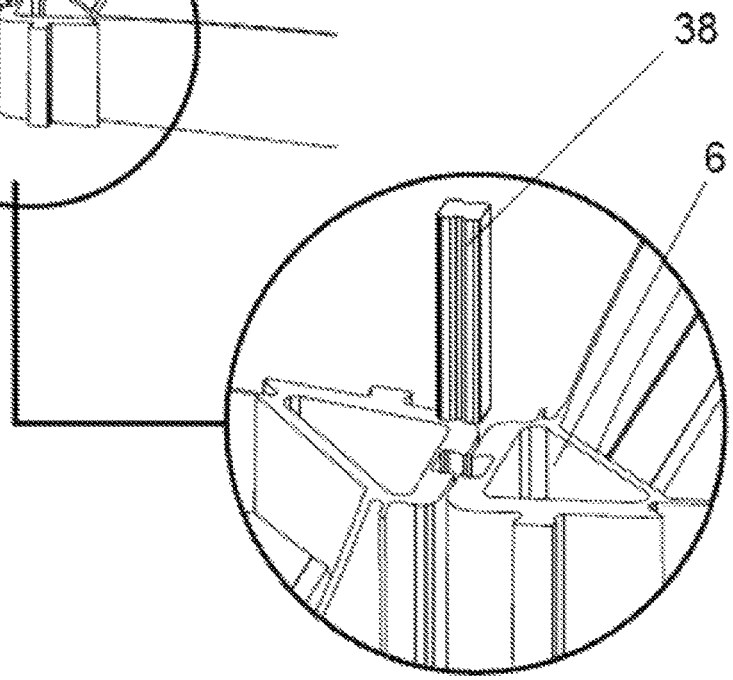
FIG. 8B.—Portrays a close-up isometric view of a diagonalized coupling between trays.
Figure 9:
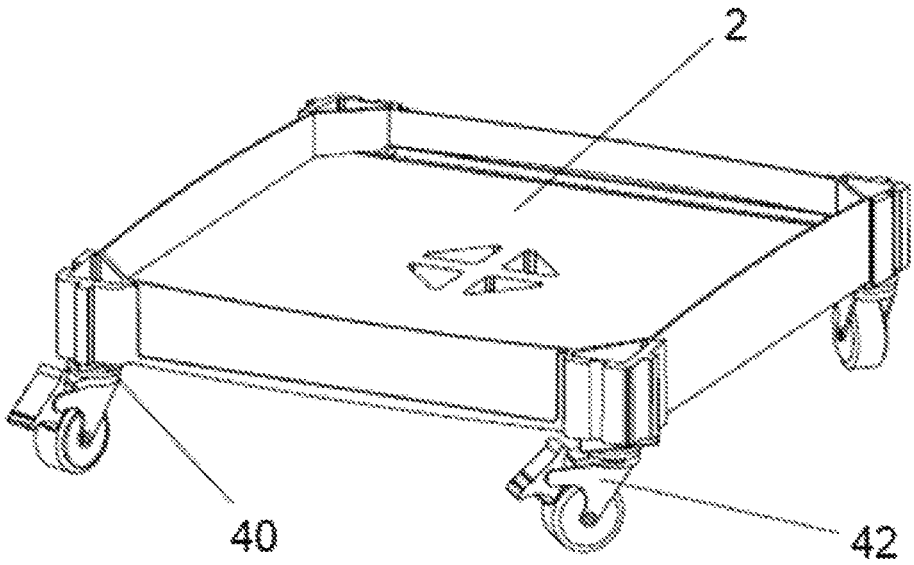
FIG. 9.—Portrays an isometric view of a tray equipped with castors.
Figure 10:
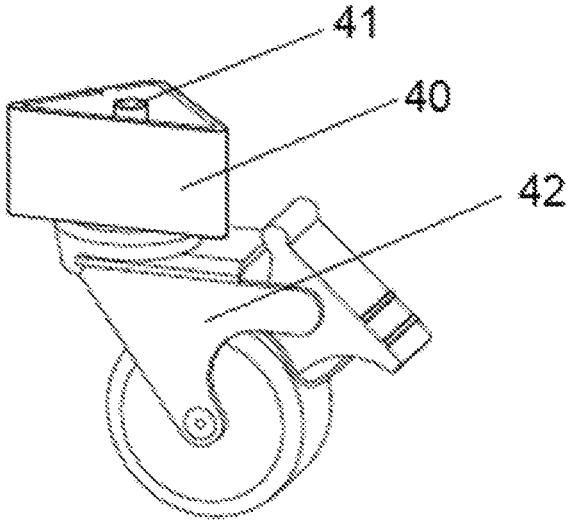
FIG. 10.—Portrays an isometric view of the accessories for the installation of castors.
Figure 11:
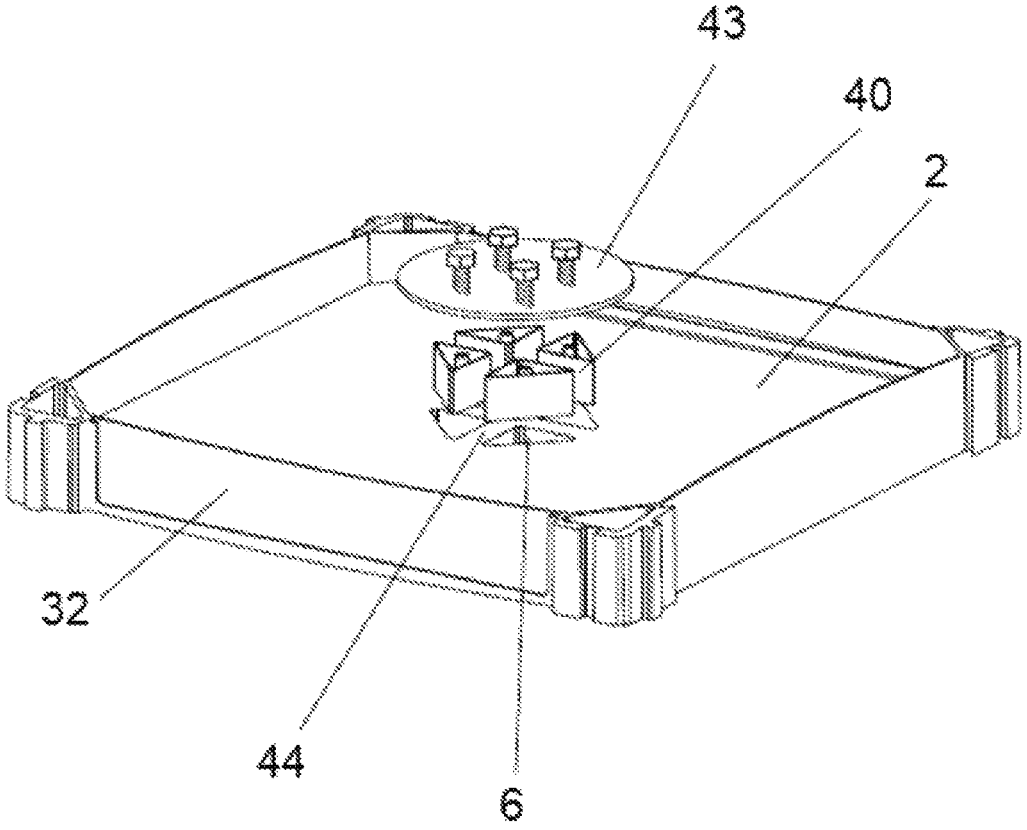
FIG. 11.—Portrays an isometric view of a tray equipped with the accessories denominated foot and circular plate installed at its central part.
Figure 12:
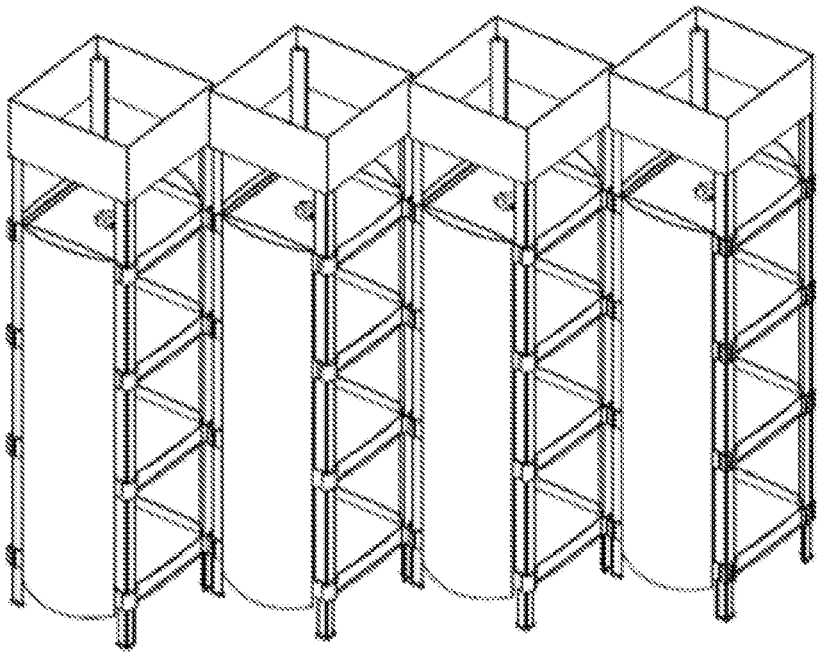
FIG. 12.—Portrays an isometric view of a diagonal configuration of shelving units.
Figure 13:
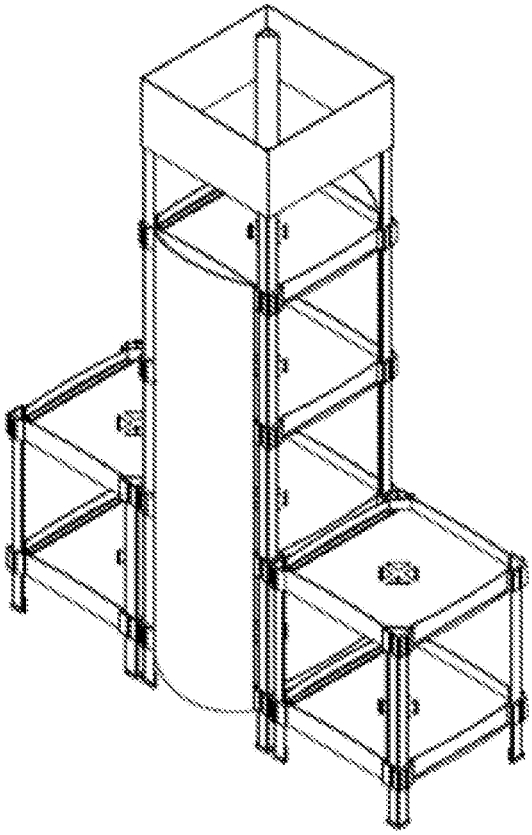
FIG. 13.—Portrays an isometric view of a configuration denominated shelving dump bin.
Figure 14:
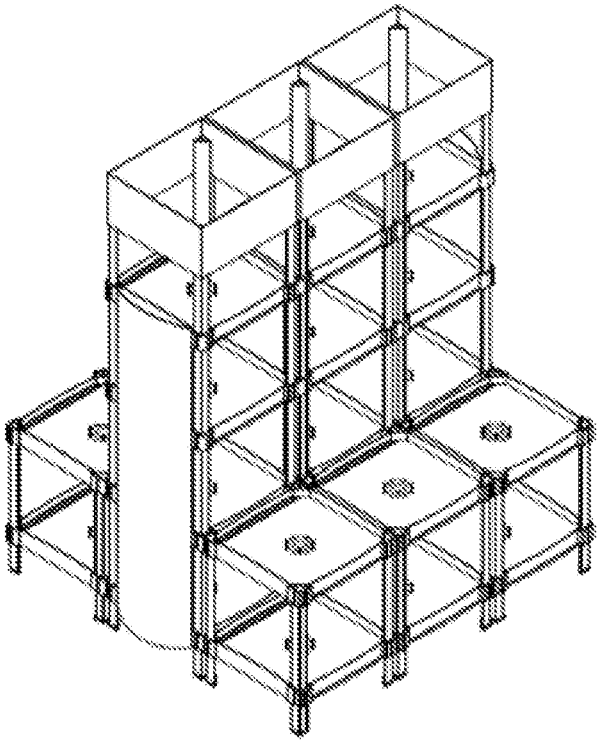
FIG. 14.—Portrays an isometric view of a configuration of three units denominated triple dump bin.
Figure 15:
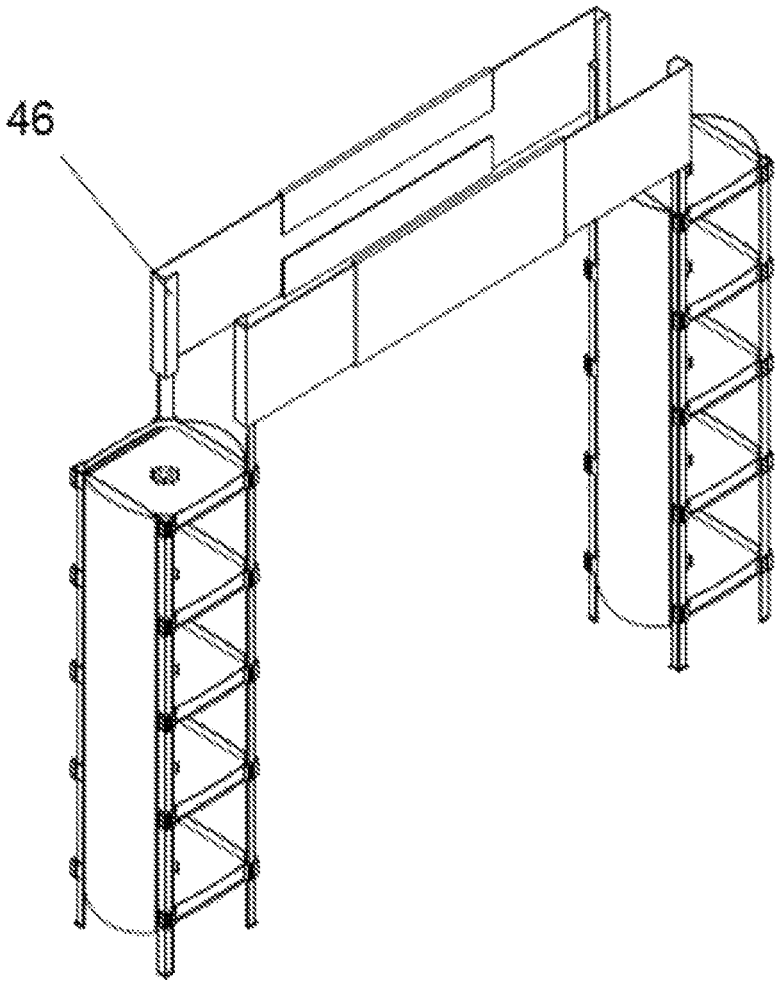
FIG. 15.—Portrays an isometric view of a so-called arch-shaped configuration, useful at exhibition stands.

The present invention will now be described hereunder in greater detail, with reference to the attached drawings, portraying the preferred modalities of the invention. This invention may, however, be expressed in many different ways and it should not be interpreted as being limited to the modalities indicated herein. Instead, these modalities are implemented herein in order that said disclosure be thorough and complete, and describing to the full the scope of the invention for those skilled in the art. Identical numbers refer to identical elements throughout the document.

The modular display system 1 which is the object of the present invention is a shelving unit comprising trays 2 at different levels, joined at their corners 4 by means of pillars 5 of a generally triangular profile with rounded corners which slot adjustedly into corresponding housings 6, one at each corner 4 and on both sides of each tray.

The housing 6 at each corner is of a generally triangular shape, featured on both sides of the tray 2. The purpose of this housing 6 is that each shall hold the pillars 5, these being of the same calibre as the housing 6, and are inserted from above and/or from below, for assembly of the shelving unit.

Additionally, at the centre 8 of the trays 2, four housings 6 are defined for pillars closely facing each other; these four housings are also intended to receive and hold pillars, but only from the flat upper surface 7 of the tray 2.

The tray 2 comprises a flat, horizontal, quadrangular surface 7 on which the products to be displayed are located, and an external wall 10, perpendicular to the flat surface 7 and whose medial line 11 is marked by the external line of the square, horizontal, flat surface 7 of the tray. The trays 2 are preferably manufactured from PP (polypropylene).

One internal side of the wall 13, above the tray 2, is that which retains the products displayed, while the internal half of the wall 14, below the tray 2, features internal ribs 45 which endow the tray 2 of the device with structure, rigidity and strength.

Each tray 2 further features at its corners 4 male-female connecting means 16, 17, to laterally connect the shelving units. The male-female connecting means 16, 17 are located vertically at the edges of each tray 2, at one extremity a female connector 16 and at the other extremity a male connector 17, at the four edges of the external wall 10.

The pillars 5 are formed by two types of extruded PVC profiles, designed to slot into the triangular housings 6 of the tray (at the corners or centrally). Assembly of the pillars 5 and the housings 6 of the tray 2 is performed by press-fitting, inserting the pillar 5 into the housing 6 and pressing said profile until it butts against the stop at the base of the housing. The shape of the profile is generally triangular with rounded extremities 19, causing the profiles to slot exactly into the housings of the tray, ensuring the firmness and rigidity of the shelving unit thus configured.

All the profiles feature perforations 20, which are used for the riveting of graphics 21 and/or anti-theft protective plates 22. The perforations 20 may also be used for the passage of the lighting cables.

Notwithstanding that the profiles are standardised, they may be sized to measure, in the event that the product to be displayed be particularly high and should require a greater space between one tray and another. There are two standard lengths of profile: the shorter, measuring 150 mm and with four perforations, and another of 350 mm. The first serves a double purpose, since its reduced length is suited, on the one hand, for the legs 23 of the shelving unit, to the underside of which a non-slip rubber ferrule 24 is attached to endow the shelving unit with adherence and sustainability. The other function of the short profiles is to act as a rail and support for the anti-theft protective plates 22. To this end, the profile features the two lateral perforations 20, located on the flat surfaces of the profile.

The other standard dimension of the profiles is 350 mm, with six perforations, and this profile, and likewise any other profile of greater length, serves to determine the internal height of the shelving unit or the separation between the trays forming the shelving unit, as required by the products to be displayed.

The pillars 5 with a generally triangular profile are extruded, hollow and manufactured from PVC (polyvinyl chloride) stabilised with tin or lead, with pairs of perforations 20 longitudinally spaced on their perpendicular sides 10, 11 and diagonal side 25.

In the trays, and at the lateral edges of the external wall 10, rectangular engaging grooves 26 are also defined, directed longitudinally with regard to a vertical plane, and laterally, departing at an acute angle with regard to this outwardly facing plane of the tray 2. The distances between grooves 26 are less than the width of the tray 2 and less than a distance between the male-female connectors 16, 17.

Furthermore, at the front edge 27 and the rearward edge 28 of the trays a channel 29 is defined, formed between vertical grooves 30 similar to the grooves 26 at the lateral sides, and a horizontal groove 31 linked to the vertical groove 30; grooves that act as a supporting channel for a flat, smooth board as for promotional graphics or for price ticket strips 32.

A flat, smooth board 33 may be inserted into the engaging grooves 26 of each tray 2, being the height of the shelving unit and covering at least one external side of two consecutive trays 2, assembled with their corresponding pillars 5. This board serves as a supporting format for the lateral promotional graphics 34, covering the entire height of the shelving unit and is fixed by tension within the engaging grooves 26.

Another device featured by the tray is a housing for LED lighting. Two lighting channels 35 have been incorporated on the surface of the tray, located at opposing internal edges of the tray 2, just inside the location of the price ticket strip supports 32. These lighting channels 35 are of the same width as an LED strip and are angled at 45° to facilitate the illumination of the products loaded in the shelving unit, enabling the illumination of the products displayed.

The LED strip is installed throughout the length of the lighting channel 35 and its cables may be routed through the interior of the shelving unit to the floor, through perforations especially located in both the tray 2 and the pillars 5.

The design of the tray also features specific perforations for the cabling of the module with the LED strips. The perforations are located at each extremity of the lighting channels 35 and enable the cable to be routed toward the lower part of the shelving unit for its connection to the power source. In addition, all the housings for the insertion of pillars feature a perforation 46 at their base, executed for the passage thereby of the cables and their downward routing.

Another important accessory is the diagonalization adaptor 38, a device consisting of a solid item of plastic, designed to be inserted so as to join two horizontal female connectors of the tray, thus enabling the joining of several shelving units to form a diagonally staggered line.

And another accessory is a foot 40 to be installed in the housings at the underside of a tray, said foot featuring a generally triangular profile and a height equal to the depth of the triangular housings 6 in the tray, with an internal threaded hole 41 for the installation of castors 42, thus to configure a mobile shelving unit.

Yet another accessory is a circular plate 43 forming a tray which, by means of the feet 40 is installed in the central housings 44 of each tray 2, enabling the generation of another surface for the placement of products on display.

And yet another accessory is the connecting device 46 formed by a plate which at its lateral edges follows the outline of a triangular profile with rounded corners; this connecting device is comprised of three plates adjustedly sliding together; a first plate or connecting item at one extremity, a central plate and a second plate or connecting item at the other extremity, in such a way that its longitudinal extension may be varied, this enabling the joining of series of shelving units of great height and spacing, by means of pillars assembled on the upper tray of each shelving unit; further enabling, by means of grooves therein, the installation of higher boards bearing promotional graphics, thus forming sizeable exhibition stands.

Finally, the tray further incorporates symbols 39 for the identification of fronts or sides. To facilitate assembly and the identification of the faces of the tray, said tray distinguishes with a plus sign (+) the sides featuring the support for the price ticket strip, and with a minus sign (−) the sides on which the supports for lateral graphics are located.

Advantageously, a method for the assembly of a shelving unit is foreseen wherein: the shelving unit is assembled from structural trays and pillars or profiles, comprising:

a) installing non-slip ferrules and/or castors on the legs or feet respectively, both of these formed by means of profiles of reduced length with regard to their transverse cross-section; said profiles generally featuring a triangular cross-section and being hollow, with rounded extremities and manufactured from PVC;

b) assembling the legs or castors beneath a quadrangular tray featuring a flat upper surface and at each corner thereof, a triangular housing with rounded extremities, at both their upper and lower sides;

c) assembling pillars at each upper corner of the tray; said pillars generally featuring a triangular cross-section and being hollow, with rounded extremities and manufactured from PVC;

d) installing another tray on the pillars, with the flat surface thereof facing upwards; and e) repeating sequences c) and d) until a shelving unit of the desired height is obtained.

In another alternative method, two identical shelving units are assembled by means of the locking together of the male-female connectors defined at the lateral sides of each tray, in such a way that a twin-section shelving unit is formed, be the sections of the same height or of different heights.

Yet other alternatives are enabled by the assembly of the shelving units by means of the male-female connectors, forming shelving units of three, four or more sections, these being rectangular, square or L-shaped, to create larger shelving units, covering a greater area within the sales outlet where they are employed.

In another preferred alternative, in the case of a shelving unit formed by at least four sections linked to form a square, pillars may be installed in one of the central housings of each tray, these being the housings nearest to the centre of the four-section shelving unit, to install a tray above the upper four trays, forming an additional level with a single tray, or in the place of the tray to install boards for promotional graphics on the pillars.

And in other alternatives connecting items are employed; these connect triangular profiles with rounded corners, to join series of shelving units of considerable height and widely spaced, enabling the installation of boards with promotional graphics thereon, to form sizeable stands for exhibitions.

Advantageously and preferably, flat, smooth boards with promotional graphics are installed at the lateral sides, between pairs of grooves defined at each lateral edge of the trays, in such a way that the boards cover the entirety of the height of the shelving unit.

In another preferred alternative, in a channel at the front edge of each tray, price ticket strip-like promotional graphics are installed, covering the entirety of the front edge of each tray.

In another alternative, polycarbonate or cardboard anti-theft plates of a width equal to the width between two pillars assembled on a tray are installed; here, the plates are secured by holders in corresponding perforations between the anti-theft plates and the pillars.

And in another alternative, pillars are installed at the corners of the upper tray of each shelving unit; a flat board with promotional graphics is installed between these pillars, the board being secured to the profiles by holders.

The use of an item denominated diagonalization adaptor is foreseen; this enables the assembly of shelving units touching only at their corners; thus, the shelving units adopt a diagonally staggered configuration.

It is also foreseen that the foot, which features a generally triangular profile, may feature an internal threaded hole for the installation of the castors, thereby configuring a mobile shelving unit.

It is foreseen that by means of a foot installed in the central housings of each tray, a circular plate may be installed to act as a tray for the placing thereon of products.

It shall be understood that the foregoing detailed description is made for illustrative purposes and that a person skilled in the art may make modifications and variations thereto without straying from the scope of the invention.

The invention claimed is:

1. A configurable, dismantlable display case system, with supports for promotional graphics, particularly suited for use as a display cabinet, which may be used at all types of shopping malls, fairs and promotional events, the constitution thereof being simple and entailing a reduced cost, and with the possibility of changing the promotional campaign thereon as many times as may be necessary, the system comprising:

a plastic shelving unit, with trays at different levels, linked at their comers by means of pillars of a generally triangular profile with rounded comers, which fit adjustedly into corresponding housings in the tray, blind housings located one at each corner and on upper and lower sides of each tray;

the tray comprises a flat, horizontal surface of a generally quadrangular shape and with a predetermined thickness, defining a frontal edge, a rearward edge and lateral edges, on which the products to be displayed are placed, and an external wall, perpendicular to the flat surface, and whose medial line is marked by the external line of each horizontal edge of the tray;

the housing at each corner is of a generally triangular shape with rounded comers, being visible and functional from both above and below the tray;

furthermore, at the center of the upper part of the tray four housings are defined, for pillars closely facing each other;

each tray further features at its corners male-female connecting means, to enable the lateral interlocking of corresponding shelving units;

the male-female connecting means are located vertically at the lateral edges of each tray, at one extremity a female connector and at the other extremity a male connector, at the four lateral edges; the pillars are formed by extruded PVC profiles, which slot into the triangular housings of the tray (at the corners or centrally) and feature perforations located spacedly at their sides;

short profiles or legs formed from extruded PVC profiles, of a more reduced length than the pillar profiles, of a generally triangular shape with rounded corners which slot adjustedly into the corresponding housings of the tray (at the corners or centrally) and also feature perforations located spacedly at their sides; and non-slip ferrules inserted into the profile forming the leg.

2. The configurable, dismantlable display case system, with supports for promotional graphics, as claimed in claim 1, further comprising the length of the shorter profiles being 150 mm and with four perforations spacedly located on their sides.

3. The configurable, dismantlable display case system, with supports for promotional graphics, as claimed in claim 1, further comprising the length of the pillar profiles being 350 mm and with six perforations spacedly located on their sides.

4. The configurable, dismantlable display case system, with supports for promotional graphics, as claimed in claim 2, further comprising the pillars of a generally triangular profile with rounded corners being extruded, hollow and manufactured from PVC (polyvinyl chloride) stabilised with tin or lead.

5. The configurable, dismantlable display case system, with supports for promotional graphics, as claimed in claim 1, further comprising at each of the lateral edges of the tray, engaging grooves that are also defined, directed longitudinally with regard to a vertical plane, and laterally, departing at an acute angle with regard to this outwardly facing plane of the tray, with the distances between grooves being less than a width of the tray and less than a distance between male-female connectors.

6. The configurable, dismantlable display case system, with supports for promotional graphics, as claimed in claim 5, further comprising that at the front edge and the rearward edge of the trays a channel is defined, formed by a pair of vertical grooves and a horizontal groove.

7. The configurable, dismantlable display case system, with supports for promotional graphics, as claimed in claim 6, further comprising a flat, smooth board of the same height as the shelving unit, as a supporting format for the lateral promotional graphics, covering the entire height of the shelving unit and fixed by tension between the grooves.

8. The configurable, dismantlable display case system, with supports for promotional graphics, as claimed in claim 7, further comprising a flat, smooth board of the same height as the trays, as a supporting format for price ticket strip-type promotional graphics, fixed by slotting into the channel.

9. The configurable, dismantlable display case system, with supports for promotional graphics, as claimed in claim 1, further comprising the tray comprising on its upper surface two channels or housings for LED (light emitting diode) lighting, located at the front edge and rearward edge of each tray, angled at 45° to facilitate the illumination of the products loaded in the shelving unit.

10. The configurable, dismantlable display case system, with supports for promotional graphics, as claimed in claim 9, further comprising the LED strip being installed throughout the length of the channel and its cables being routed through the interior of the shelving unit to the floor, through perforations located in both the tray and the profiles.

11. The configurable, dismantlable display case system, with supports for promotional graphics, as claimed in claim 10, further comprising that the perforations for the cabling of the module with LED strips are located at each extremity of the illumination channel and enable the cable to be routed toward the lower part of the shelving unit for its connection to the power source; in addition, all the housings for the insertion of pillars feature a perforation at their base, executed for the passage thereby of the cables and their downward routing.

12. The configurable, dismantlable display case system, with supports for promotional graphics, as claimed in claim 1, further comprising a rectangularly-shaped anti-theft sheet of polycarbonate, cut to the width of the tray and perforated in order to fit together with the standard perforations of the extruded profiles.

13. The configurable, dismantlable display case system, with supports for promotional graphics, as claimed in claim 1, further comprising a diagonalization adaptor, a device comprising a solid item of plastic, with a profile corresponding to the male connector of the tray, designed to be inserted so as to join two horizontal female connectors of the tray, thus enabling the joining of several shelving units to form a diagonally staggered line.

14. The configurable, dismantlable display case system, with supports for promotional graphics, as claimed in claim 1, further comprising a foot for the installation of castors or of a circular plate acting as a tray; said foot is of a generally triangular profile with rounded comers and featuring an internal threaded hole, and with a height equal to the depth of the housing.

15. The configurable, dismantlable display case system, with supports for promotional graphics, as claimed in claim 14, further comprising the circular plate acting as a tray, by means of the foot and a number of studs, is installed in the central housings of each tray, enabling the generation of another surface above the tray for the placement of products to be displayed.

16. The configurable, dismantlable display case system, with supports for promotional graphics, as claimed in claim 1, further comprising a connecting device formed by a plate which follows the outline of the triangular profile with rounded comers, featuring one part with a flat surface which couples to an elongated rectangular plate, enabling the installation of boards with promotional graphics thereon.

17. A method for the assembly of a configurable, dismantlable display case system, with supports for promotional graphics, particularly suited for use as a display cabinet, which may be used at all types of shopping malls, fairs and promotional events, the constitution thereof being simple and entailing a reduced cost, and with the possibility of changing the promotional campaign thereon as many times as may be necessary, the method comprising the steps of:

a) supplying a tray comprised of a flat, generally quadrangular horizontal surface, and with a predetermined thickness defining a frontal edge, a rearward edge and lateral edges, on which the products to be displayed are placed, and an external wall, perpendicular to the flat surf ace; each tray further features at its comers male-female connecting means, enabling the lateral interlocking of corresponding shelving units; the male-female connecting means being located vertically at the lateral sides of each tray, at one extremity a female connector and at the other extremity a male connector at the four lateral edges; with housings at each corner of a generally triangular shape with rounded comers, both above and below the tray;

b) supplying pillars formed by extruded PVC profiles, which slot into the triangular housings of the tray and featuring perforations spacedly located at their sides;

c) supplying legs or short profiles formed by extruded PVC profiles of a more reduced length than the pillar profiles, with a generally triangular shape and with rounded comers which slot adjustedly into the corresponding housings of the tray and also featuring perforations spacedly located at their sides; and d) installing non-slip ferrules on the legs;

e) assembling the legs below a quadrangular tray featuring a flat upper surface and triangular housings with rounded extremities at each corner of its upper and lower faces;

f) assembling pillars at each corner of the tray; said pillars being formed by profiles generally featuring a triangular cross-section and being hollow, with rounded extremities and manufactured from PVC;

g) installing another tray on the pillars, with its flat surface facing upwards; and h) repeating the sequence f) and g) until a shelving unit of the desired height is obtained.

18. The method for the assembly of a configurable, dismantlable display case system, with supports for promotional graphics, as claimed in claim 17, the method further comprising that two shelving units may be assembled by means of the joining of the male-female connectors defined at the lateral sides of each tray, in such a way that a twin-section shelving unit is formed, be the sections of the same height or of different heights.

19. The method for the assembly of a configurable, dismantlable display case system, with supports for promotional graphics, as claimed in claim 17, the method further comprising that three or more shelving units may be assembled by means of the joining of the male-female connectors defined at the lateral sides of each tray, forming shelving units of three, four or more sections, forming rectangular, square or L-shaped shelving units, each section being of the same height or of different heights, to create larger shelving units, covering a greater area within the sales outlet where they are employed.

20. The method for the assembly of a configurable, dismantlable display case system, with supports for promotional graphics, as claimed in claim 19, the method further comprising the step of installing feet, to be installed in triangular housings on the underside of a tray; each foot features a generally triangular profile with a threaded hole for the installation of castors, thus to configure a mobile shelving unit.

* * * * *